US005108084A

United States Patent [19]

Ishikawa et al.

[11] Patent Number: 5,108,084

[45] Date of Patent: Apr. 28, 1992

[54] SHEET FEEDER PROVIDED WITH BOTH AUTOMATIC SHEET FEEDING FUNCTION AND MANUAL SHEET FEEDING FUNCTION

[75] Inventors: Shigeo Ishikawa, Aichi; Hiroshi Tokuda, Nagoya; Seijiro Kadowaki; Fumio Morita, both of Nagoya; Hirokazu Kishimoto, Iwakura, all of Japan

[73] Assignee: Brother Kogyo Kabushiki Kaisha, Aichi, Japan

[21] Appl. No.: 699,009

[22] Filed: May 13, 1991

[30] Foreign Application Priority Data

Jul. 30, 1990 [JP] Japan ..... 2-202265

[51] Int. Cl.[5] ..... B65H 3/44

[52] U.S. Cl. ..... 271/9; 271/114; 271/117; 271/121; 271/170

[58] Field of Search ..... 171/9, 114, 117, 118, 171/121, 126, 127, 165, 170

[56] References Cited

U.S. PATENT DOCUMENTS 4,424,964 1/1984 Kikuchi et al. ..... 271/9
4,896,871 1/1990 Idenawa ..... 271/9

FOREIGN PATENT DOCUMENTS

3930047A1 3/1990 Fed. Rep. of Germany .
62-140945 6/1987 Japan ..... 271/9
2-75533 3/1990 Japan .
2-138026 5/1990 Japan .
2223744A 4/1990 United Kingdom .

OTHER PUBLICATIONS

IBM Technical Disclosure Bulletin, vol. 17, No. 4, p. 958, Sep. 1974, "Priority Insertion Card Mechanism", R. E. Hunt.

*Primary Examiner*—David H. Bollinger
*Attorney, Agent, or Firm*—Oliff & Berridge

[57] ABSTRACT

A sheet feeding device for automatically feeding sheet paper from a cassette or feeding one sheet of paper at a time as the sheets are inserted into an insertion guide. The paper is fed in the automatic feed mode by bringing the stacked paper and a rotating sheet feeding roller into contact with one another. When the manual feed mode is selected, the stacked paper and the rotating roller are separated. A sheet of paper placed in the insertion guide is fed to a contact point between the sheet feeding rollers, now rotating counter to the rotational direction during automatic sheet feeding, and an opposing pressure rollers.

14 Claims, 7 Drawing Sheets

SHEET FEEDER PROVIDED WITH BOTH AUTOMATIC SHEET FEEDING FUNCTION AND MANUAL SHEET FEEDING FUNCTION

BACKGROUND OF THE INVENTION

1. Field of the Invention

This invention relates to a sheet feeder for feeding a sheet to a printing unit such as a printer, a copying machine or a recording unit in an image copying machine. More particularly, it is drawn to a sheet feeder capable of executing both an automatic sheet feeding operation and a manual sheet feeding operation.

2. Description of the Related Art

Among sheet feeders provided with both an automatic sheet feeding function and a manual sheet feeding function, one type, as illustrated in FIG. 9, is well known. In the known type of sheet feeder, a sheet cassette 104 holding a plurality of stacked sheets 102 is incorporated in the sheet feeding mechanism of a device such as a printer or a copying machine. In the sheet feeding mechanism, there is disposed a first sheet feeding roller 106 for the automatic sheet feeding operation. The sheets 102 stacked in the sheet cassette 104 are fed in order from the top to a recording unit 108 using a frictional force generated by the rotation of the first sheet feeding roller 106.

In addition, a second sheet feeding roller 110 and a pressure roller 112 for a manual sheet feeding operation are arranged in a manual sheet feeding passage 114. The sheet is fed to the recording unit 108 while being held between the rollers.

In this type of sheet feeder, however, special mechanisms are required for the automatic sheet feeding operation and the manual sheet feeding operation, respectively, with attendant problems caused by the large number of component parts and complicated mechanisms leading to difficulties in assembly and a high failure rate.

SUMMARY OF THE INVENTION

It is, therefore, an object of this invention to provide a sheet feeder having both an automatic sheet feeding function and a manual sheet feeding function in a less complex device.

It is another object of this invention to commonly use the sheet feeding rollers for both the automatic sheet feeding operation and the manual sheet feeding operation, thus reducing component parts and simplifying the overall structure.

It is a further object of this invention to avoid problems generated in the case where the automatic sheet feeding operation and the manual sheet feeding operations are accidentally executed at the same time.

It is a still further object of this invention to enhance the operability of a sheet feeding operation.

To attain the above and other objects, there is provided a sheet feeder, according to the present invention, having both an automatic sheet feeding function, for feeding a plurality of sheets stacked in a sheet cassette in sequence to a recording unit using a frictional force generated by the rotation of sheet feeding rollers, and a manual sheet feeding function, for manually feeding the sheet to the recording unit. The sheet feeder comprises a separating means for separating the sheet feeding rollers from the sheets stacked in the cassette during the manual sheet feeding operation, a roller driving means for rotating the sheet feeding rollers in a normal direction during automatic sheet feeding while rotating the sheet feeding rollers in a reverse direction during manual sheet feeding, and pressure rollers opposing the sheet feeding rollers for guiding a manually fed sheet to the recording unit between the pressure rollers and the sheet feeding rollers when the sheet feeding rollers are rotated in a reverse direction to the automatic feed rotation direction.

With the construction described above, during the automatic sheet feeding operation, the sheet can be fed by the rotation of the sheet feeding rollers, one of which is pressed in contact with the top sheet of the sheets stacked in the sheet cassette. In the manual sheet feeding operation, the sheet is fed to the recording unit by the reverse rotation of the sheet feeding rollers. During manual sheet feed, the sheet feeding rollers and the sheets stacked in the sheet cassette are separated from one another by a pushdown member.

In the sheet feeder according to this invention, since the sheet feeding rollers can be commonly used both in the automatic sheet feeding operation and the manual sheet feeding operation, special sheet feeding rollers for the manual sheet feeding operation are unnecessary. Accordingly, the number of component parts is reduced producing a simple structure, the fault rate is lowered, and assembly and maintenance facilitated.

Moreover, a single drive source can be used in the normal rotation or in reverse rotation depending on whether the automatic sheet feeding or the manual sheet feeding operation is being used, thereby preventing simultaneous use in both possible operating modes. Thus, the manual sheet feeding operation will not occur even if the user tries to manually feed a sheet by mistake during the automatic sheet feeding operation, thereby preventing the problems that can occur when the automatic sheet feeding operation and the manual sheet feeding operation are executed at the same time.

However, even in the automatic sheet feeding operation, the sheet can be manually inserted into the manual feed guides in advance, thereby enhancing the operability.

BRIEF DESCRIPTION OF THE DRAWINGS

A preferred embodiment of the present invention will be described in detail with reference to the following figures, wherein.

DETAILED DESCRIPTION OF THE PREFERRED EMBODIMENTS

Figure 1:
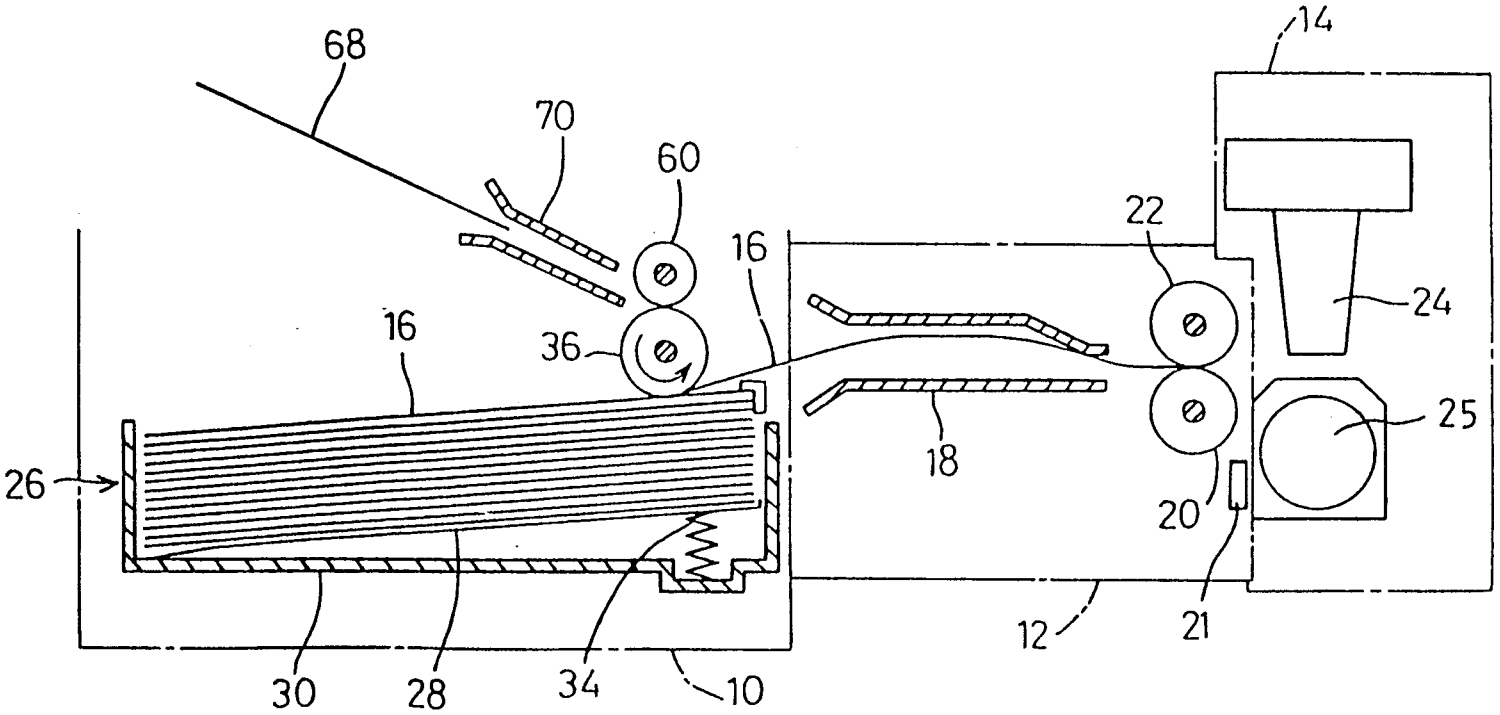
FIG. 1 is an overall schematic view of a printing apparatus incorporating a sheet feeder of a preferred embodiment according to this invention.

FIG. 1 is a cross-sectional view of the major components of a printing apparatus incorporating a sheet feeder 10 according to one embodiment of the invention. The printing apparatus is composed of three units, that is, the sheet feeder 10, a feeding unit 12 and a printing unit 14. A sheet (cut sheet) 16 introduced by the sheet feeder 10 is advanced along a feeding guide 18 disposed in the feeding unit 12 so as to be held between a sheet feeding roller 20 and a nip roller 22 positioned at the downstream side of the feeding unit 12. The sheet 16 is fed to the printing unit 14 where a predetermined printing operation is executed with respect to the sheet 16, positioned on a platen 25, by a printhead 24.

Figure 2:
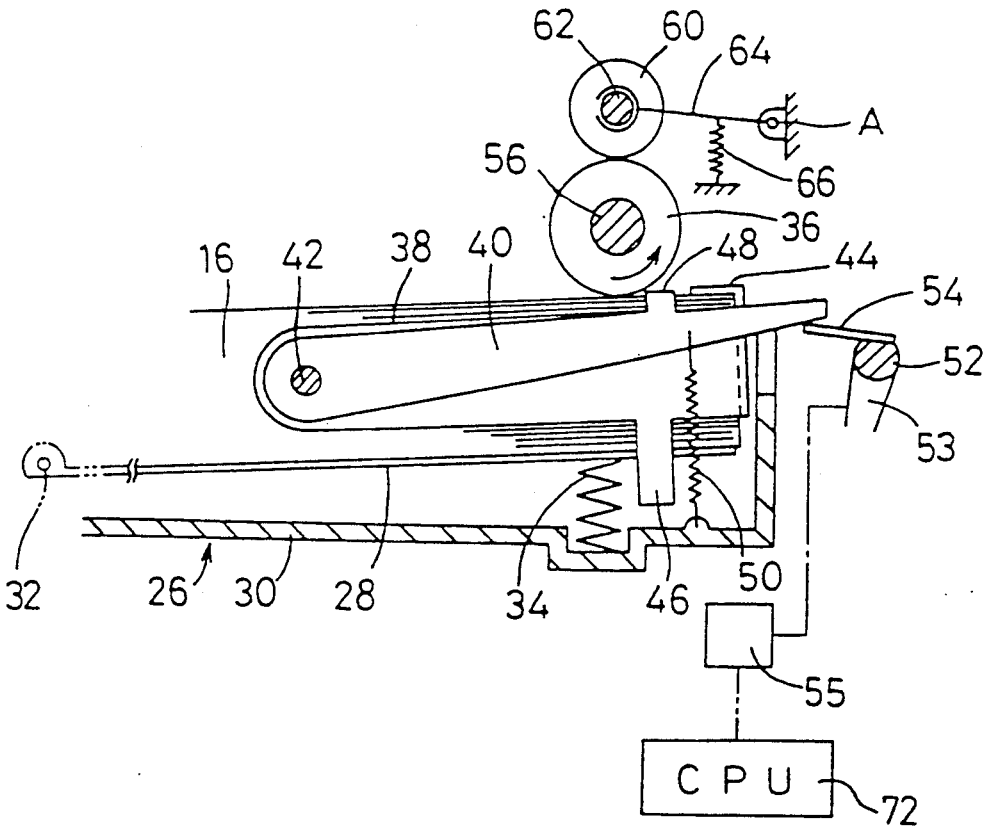
FIG. 2 is a cross-sectional view of the major components showing an automatic feeding state of the sheet feeder.

Housed in the sheet feeder 10 is a sheet cassette (hereinafter referred to as a "cassette") 26 wherein a plurality of sheets 16 are stacked. The cassette 26 is provided with a supporting plate 28 for supporting the sheets 16 inside a case main body 30. The supporting plate 28 is pivotally supported at one end by a shaft 32 as shown in FIG. 2. The supporting plate 28 is pushed upwardly, at the end away from shaft 32, by a compression spring 34 so that the uppermost sheet 16 is pressed into contact with sheet feeding rollers 36. At each corner of the front or lead edge, in the direction of feed, of the stacked sheets 16, there is disposed a sheet separating member 38 and a pushdown member 40, respectively. The sheet separating member 38 and the pushdown member 40, on each side, are rotatably supported by a shaft 42, mounted to the inner side walls of the sheet feeder.

Figure 3:
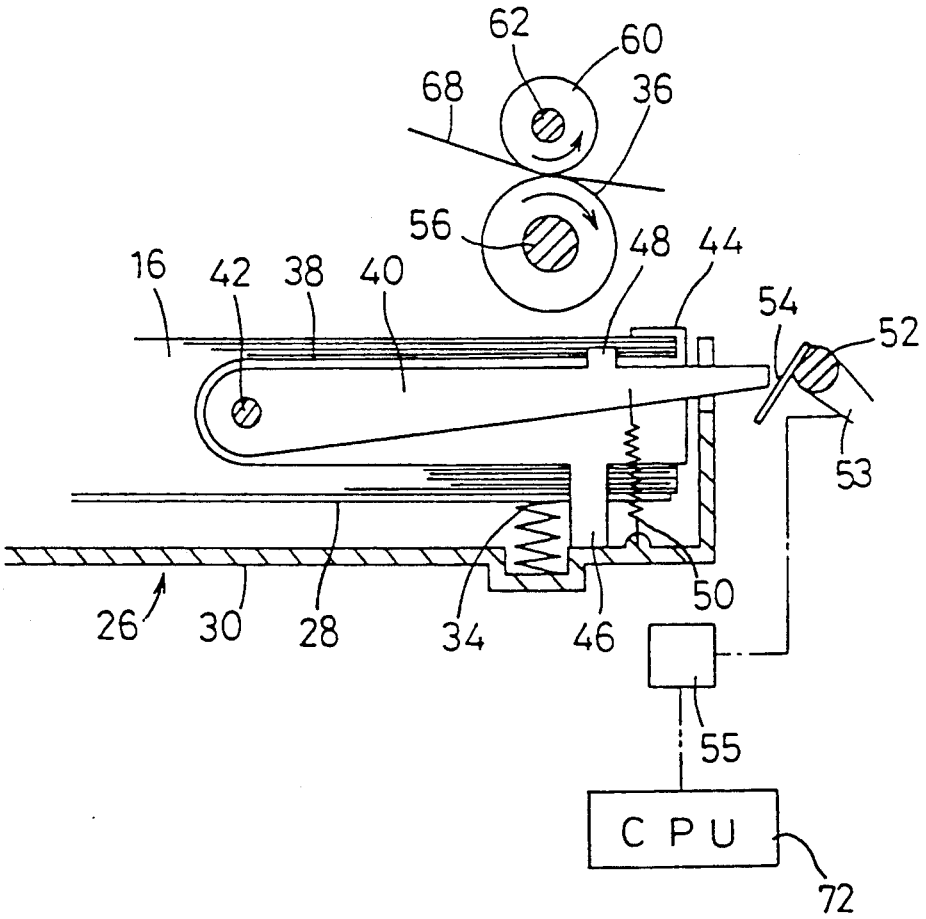
FIG. 3 is a cross-sectional view of the major components showing a manual feeding state of the sheet feeder.
Figure 4:
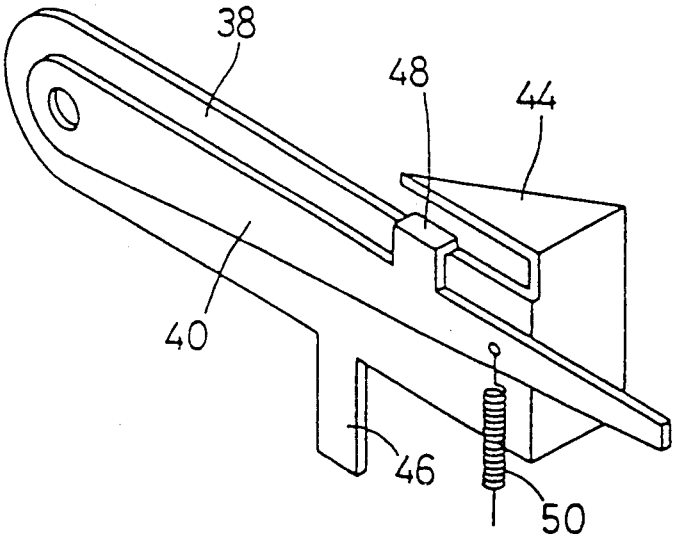
FIG. 4 is a perspective view of a sheet separating member and a pushdown member of the sheet feeder.

As shown in FIG. 4, the sheet separating member 38 is provided, at the tip thereof, with a separating nail 44 for pressing down the front corner of the sheet 16. The pushdown member 40 engages an upper edge of the sheet separating member 38 with an engaging piece 48 while being drawn downwardly by a tension spring 50. The force of the tension spring 50 is greater than that of the compression spring 34 that upwardly presses the supporting plate 28. Accordingly, in a normal state as shown in FIG. 3, the sheet separating member 38 is kept in a lowered position where an abutting piece 46, formed in the lower edge of the sheet separating member 38, abuts the floor of the case main body 30. As a result, a gap exists between the uppermost sheet 16, of the stacked sheets in the cassette 26, and the sheet feeding rollers 36.

Pushup projections 54, integrally extending from a shaft 52, can be engaged with the free end of the pushdown members 40. The shaft 52 is rotated within a predetermined angular range by a solenoid 55 via a lever 53. The solenoid 55 is connected to a CPU 72. In a shifting process from an inoperative position shown in FIG. 3 to an operative position shown in FIG. 2, the pushup projections 54 lift the free end of the pushdown members 40, against the force of tension springs 50, to lift the engaging pieces 48 of the pushdown members 40 from the sheet separating members 38. As a result, the uppermost sheet 16 in the cassette 26 is pressed into contact with the sheet feeding rollers 36 by the compression spring 34.

Figure 5:
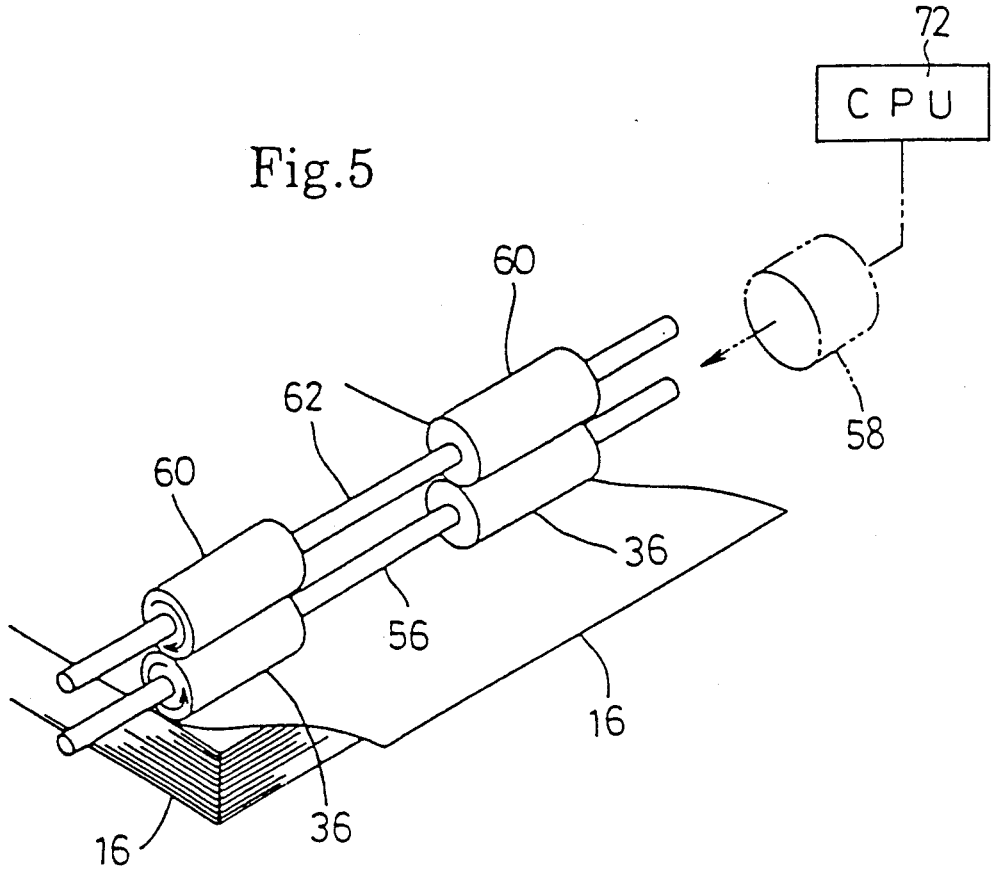
FIG. 5 is a perspective view showing an automatic feeding state corresponding to FIG. 3.

Roller shaft 56 is located corresponding to the front or lead edge, in the direction of feed, of the sheets 16 stacked in the cassette 26. As shown in FIG. 5, the pair of sheet feeding rollers 36 are fixed around the roller shaft 56 at an interval narrower by a specific length than the width of the sheets 16. A roller driving motor 58 is connected to the roller shaft 56. The roller driving motor 58 can be rotated in both a normal and a reverse direction by the CPU 72, for rotating the sheet feeding rollers 36 normally and in reverse.

Opposing the sheet feeding rollers 36 are a pair of pressure rollers 60 that serve as pressing members and are secured to roller shaft 62, parallel to the roller shaft 56, at an interval equal to that of the sheet feeding rollers 36. The roller shaft 62 is capable of pivoting around a fulcrum A by means of two arms 64, one of which is shown in FIG. 2. The pressure rollers 60 are pressed against the corresponding sheet feeding rollers 36 via the roller shaft 62 by tension springs 66. The pressure rollers 60 are rotated in a direction opposite to a rotary direction of the sheet feeding rollers 36 by frictional contact with the sheet feeding rollers 36 or a sheet 16 passing therebetween.

An insertion guide 70 for guiding a manually fed sheet 68 is affixed as illustrated in FIG. 1. The insertion guide 70, upstream of the sheet feeding rollers 36, extends slantwise toward the rolling contact portion of the sheet feeding rollers 36 with the pressure rollers 60. The ends of the upper and lower portions of insertion guide 70, on the sheet insertion side, are widened outwardly to facilitate the insertion of the sheet 68.

Next, operation of the apparatus will be explained.

When a user selects the automatic sheet feeding mode by operating a switch (not shown), the pushup projections 54 are shifted toward the operative position with energization of the solenoid 55 and push the free end of the pushdown members 40 upwardly against the force of the tension springs 50 as shown in FIG. 2. As a result, the uppermost sheet 16, stacked in the cassette 26, is pressed against the sheet feeding rollers 36 by the compression spring 34. At this time, the sheet feeding rollers 36 are normally rotated (counterclockwise in this embodiment) by the motor 58, shown in FIG. 5, so that the uppermost sheet 16 is curved at both front corners thereof pushing the sheet 16 over and free of the separating nails 44 to be fed to the feeding guide 18. As the sheet is fed from cassette 26, through feeding guide 18, the leading edge of sheet 16 is caught between the nip roller 22 and the sheet feeding roller 20. The presence of the sheet 16 is detected by a sheet detecting sensor 21 so that the solenoid 55 is deenergized. Subsequently, the sheet 16 is separated from the sheet feeding rollers 36 and fed into the printing unit 14 while the now topmost sheet 16 in cassette 26 is separated from rollers 36.

Figure 6:
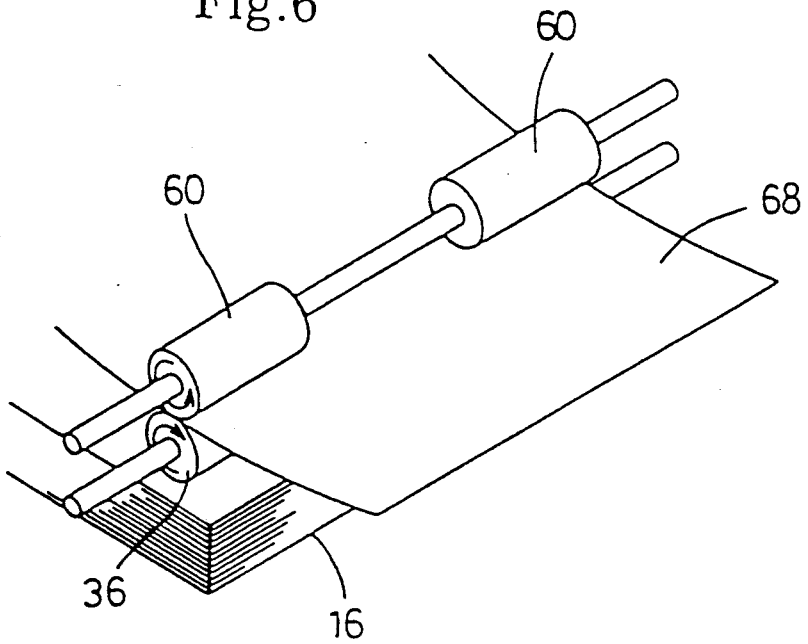
FIG. 6 is a perspective view showing a manual feeding state.

When the user selects a manual sheet feeding mode by use of a switch (not shown), the pushup projections 54 are maintained in the inoperative position because the solenoid 55 is not energized, as shown in FIG. 3. As a result, the pushdown members 40, pulled by tension springs 50, push the uppermost sheet 16 downward until the abutting piece 46 of the sheet separating members 38 abuts the floor of the case main body 30 and the topmost sheet 16 and the sheet feeding rollers 36 are separated from each other. During manual sheet feeding, the sheet feeding rollers 36 are reversely rotated (clockwise in this embodiment) so that the sheet 68 fed in through the insertion guide 70 is drawn in between the reversely rotating sheet feeding rollers 36 and the pressure rollers 60, as shown in FIG. 6, to be advanced to the feeding guide 18.

As described above, the sheet 16 or 68 is fed to the printing unit 14 in the automatic sheet feeding mode or in the manual sheet feeding mode, respectively, where the printing operation is performed.

As is obvious from the above explanation, the sheet feeding rollers 36 are used both in the automatic sheet feeding mode and the manual sheet feeding mode by switching their rotational direction.

Furthermore, as shown in FIG. 2, the sheet feeding rollers 36 are rotated normally during automatic sheet feeding, that is opposite the rotation for a manually feed sheet. Therefore, even if the sheet 68 is inserted into the insertion guide 70 during the automatic sheet feeding operation, the sheet 68 remains in the insertion guide 70 as the rotating sheet feeding rollers 36 repel sheet 68. Therefore, the potential problem of a manual feed sheet 68 being is drawn into the fed path during the automatic sheet feeding operation is eliminated and the sheet 68 may be set in the insertion guide 70 prior to a future manual sheet feeding operation. Such a capability enhances the operability of the sheet feeding device.

Figure 8:
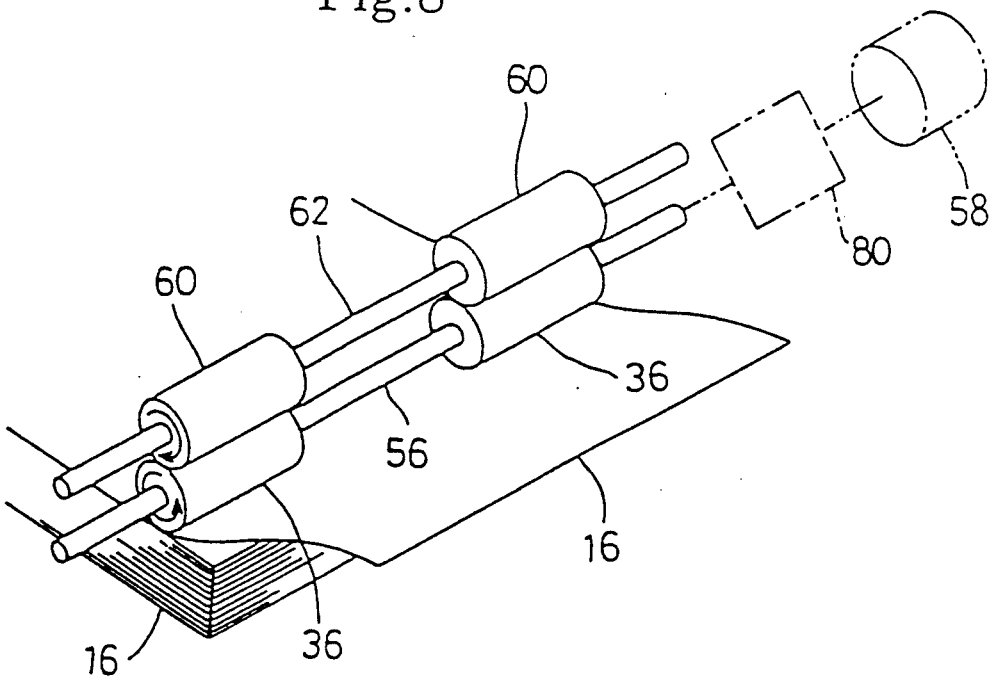
FIG. 8 is a schematic cross-sectional view of a further embodiment according to the invention.
Figure 9:
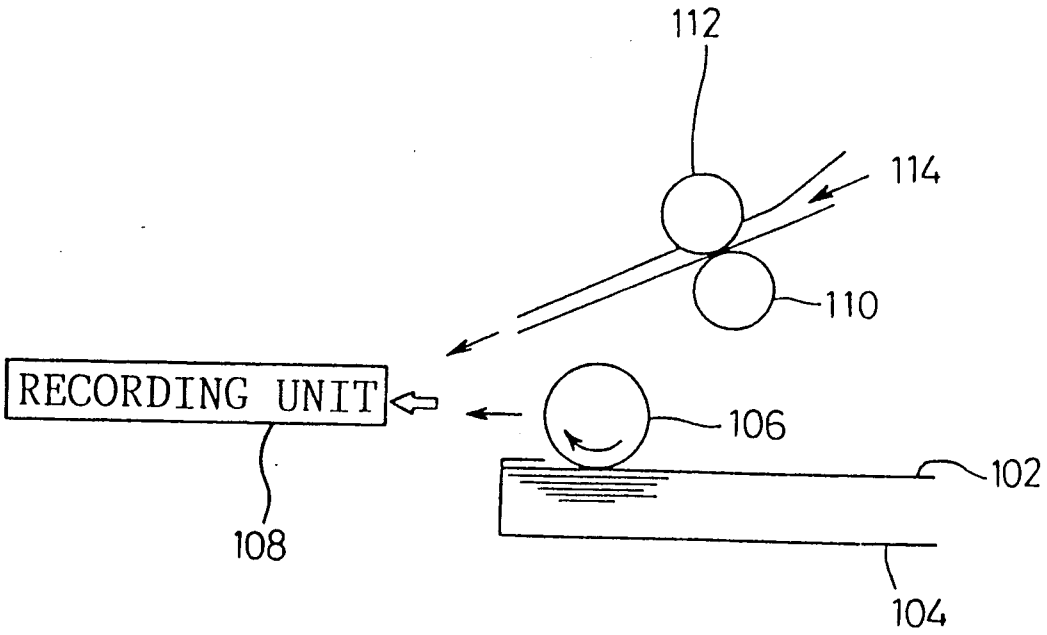
Fig.9 RELATED ART
FIG. 9 is a schematic view of a conventional sheet feeder.

In addition, a clutch 80 may be provided as shown in FIG. 8. In the automatic sheet feeding operation, the sheet 16 is detected by the sheet detecting sensor 21 with the sheet feeding rollers 36 pressed against the sheet 16 and with the solenoid 55 operative, the clutch 80 disengages the roller driving motor 58 driving the roller shaft 56. In this case, a load cannot be generated for feeding out the sheet 16 to the printing unit 14 even if the sheet feeding rollers 36 are pressed against the sheet 16.

Figure 7:
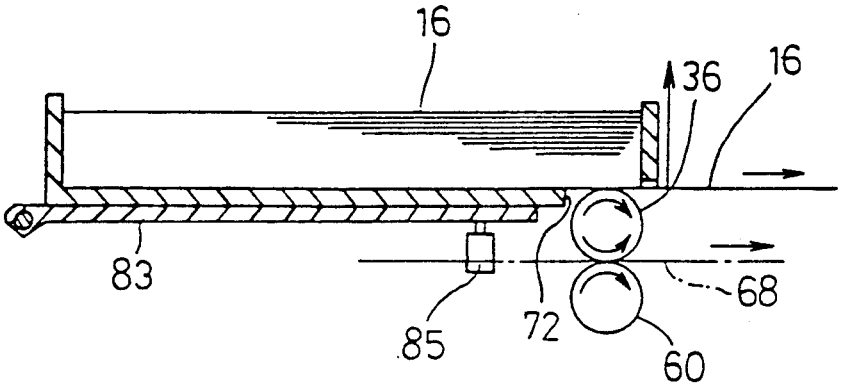
FIG. 7 is a schematic cross-sectional view of another embodiment according to the invention.

FIG. 7 shows another embodiment according to the invention. The sheet feeding rollers 36 are disposed under the sheet cassette 26 and are brought into contact with the lowermost sheet 16 at a notch 72 formed in the floor of the cassette 26. In addition, the pressure rollers 60 are pressed upwardly against the sheet feeding rollers 36. The sheet 68 in the manual feeding operation is held between both rollers 36 and 60, under the cassette 26, for feeding.

In this embodiment, the sheet cassette 26 is mounted on support plate 83. Support plate 83 is pivotally mounted in sheet feeder 10 so that notch 72, and the end of the sheet 16 exposed therein, can be raised out of contact with sheet feeding rollers 36. Support plate 83 extends beyond the sides of sheet cassette 26. Mounted below the extensions, on both sides and at the free end of support plate 83 near sheet feeding rollers 36, are solenoids 85. During the automatic sheet feeding operation, solenoids 85 are not excited. As a result, support plate 83 remains substantially horizontal and the bottom most sheet 16 in sheet cassette 26 is in contact with the sheet feeding rollers 36. When the manual sheet feeding operation is selected, the solenoids 85 are excited and push the free end of the support plate 83 upwardly so that the bottom most sheet 16 no longer contacts the sheet feeding rollers 36. The solenoids 85, because they are under extensions of the support plate 83 beyond the sides of the sheet cassette 26, are separated such that a cut sheet may be fed between them in the manual sheet feeding operation.

It is also possible to place the solenoids 85 above the sides of the sheet cassette 26 and support plate 83 so that they lift the free end of support plate 83 during the manual sheet feeding operation, that is, when the solenoids 85 are not excited, and they lower the free end of the support plate 83 when excited during automatic sheet feed operations.

It should be understood that many changes and modifications may be made in the disclosed embodiment without departing from the scope of the invention. For example, the pressing member, such as the pressure rollers 60, may be pressed against the sheet feeding rollers 36 only during the manual sheet feeding operation.

What is claimed is:

1. A sheet feeder having both an automatic sheet feeding function for feeding a plurality of sheets stacked in a sheet cassette in sequence to a recording unit and a manual feed sheet feeding function for manually feeding a sheet to the recording unit, said sheet feeder comprising:

sheet feeding rollers;

roller driving means for normally rotating the sheet feeding rollers in a first direction for automatic sheet feeding and reversely rotating in a second direction the sheet feeding rollers for manual sheet feeding;

pressure rollers abutted against the sheet feeding rollers, said pressure rollers for the manual sheet feeding operation for guiding a manually fed sheet to the recording unit with the rotation in the second direction of the sheet feeding rollers, the sheet being held between the sheet feeding rollers and the pressure rollers; and separating means for separating the sheet feeding rollers from the sheets stacked in the sheet cassette at least during manual sheet feeding.

2. A sheet feeder according to claim 1, further comprising a manual insertion guide having a upper portion and a lower portion having ends on a sheet insertion side that are widened outwardly, said manual inserting guide defining a manual sheet feeding passage to guide the manually fed sheet to a nip between said sheet feeding rollers and said pressure rollers.

3. A sheet feeder according to claim 1, further comprising an approaching means for bringing the sheet feeding rollers into contact with the sheets stacked in the sheet cassette during automatic sheet feeding operation.

4. A sheet feeder having both an automatic sheet feeding function and a manual sheet feeding function, said sheet feeder comprising:

sheet feeding rollers;

pressure rollers abutted against said sheet feeding rollers;

a manual sheet feeding passage through which a manually fed sheet is insertingly guided to a space between said sheet feeding rollers and said pressure rollers;

driving means for normally or reversely rotating said sheet feeding rollers;

separating means for separating said sheet feeding rollers from cut sheets stacked in a sheet cassette; and control means for controlling said driving means to normally rotate said sheet feeding rollers during automatic sheet feeding to feed the sheet in contact with said sheet feeding rollers to a recording unit and to reversely rotate said sheet feeding rollers during manual sheet feeding, said control means controlling said separating means to separate the cut sheets in the sheet cassette from the sheet feeding rollers so as to feed the manually fed sheet to the recording unit through the space between said sheet feeding rollers and said pressure rollers.

5. A sheet feeder as claimed in claim 4, wherein said separating means comprises:

a sheet separating member;

a pushdown member, said sheet separating member and said pushdown member pivotally mounted at one end to a side of the sheet cassette;

an engaging piece mounted to an upper edge of said pushdown member, said engaging piece contacting an upper edge surface of said sheet separating member during manual sheet feeding;

an abutting piece extending from a lower edge surface of said sheet separating member;

a force exerting linkage between said pushdown member and a floor of the sheet cassette; and a pushup member in contact with an under surface at an end of said pushdown member away from the pivotal mount.

6. A sheet feeder as claimed in claim 5, further comprising:

an arm assembly mounted to the sheet feeder, said arm assembly having two arms extending substantially parallel to a cut sheet feed path and mounting a roller shaft therebetween, said pressure rollers mounted on said roller shaft, and a force exerting linkage for positively effecting the abutting of the pressure rollers against the sheet feeding rollers.

7. A sheet feeder having both an automatic sheet feeding function and a manual sheet feeding function, said sheet feeder comprising:

sheet feeding means rotatable to feed a sheet from a sheet cassette;

driving means for normally or reversely rotating the sheet feeding means;

separating means for separating the sheet feeding means and a sheet stored in the sheet cassette;

manual feeding means cooperating with the sheet feeding means for feeding a manually supplied sheet; and control means for controlling the driving means to normally rotate the sheet feeding means during automatic sheet feeding to feed a sheet from the sheet cassette in contact with the sheet feeding means and to reversely rotate the sheet feeding means during manual sheet feeding to feed a manually supplied sheet in cooperation with the manual feeding means, said control means controlling the separating means to separate the sheet feeding means and a sheet stored in the sheet cassette during manual sheet feeding.

8. A sheet feeder as claimed in claim 7, wherein the sheet feeding means comprises sheet feeding rollers rotatable about a fixed axis and the manual feeding means comprises pressure rollers abutted against the sheet feeding rollers.

9. A sheet feeder as claimed in claim 8, wherein a sheet stored in the sheet cassette is urged to contact the sheet feeding rollers by movement of a compression member positioned in the sheet cassette on a side of the sheet opposite to said sheet feeding rollers and the separating means separates the sheet stored in the sheet cassette from the sheet feeding rollers by exerting a greater counterforce to a force of the compression member.

10. A sheet feeder as claimed in claim 9, wherein the separating means includes an electromagnetic means for applying a force additive to the force of the compression member thereby overcoming the counterforce, operation of the electromagnetic means being controlled by the control means.

11. A sheet feeder as claimed in claim 10, wherein the separating means further includes an elastic member that exerts the counterforce that is greater than the force of the compression member and the electromagnetic means operates to make the elastic member effective or ineffective.

12. A sheet feeder as claimed in claim 7, wherein the sheet cassette stores cut sheets and the sheet feeding means is disposed above the sheet cassette to feed a top most sheet of the cut sheets stored in the sheet cassette.

13. A sheet feeder as claimed in claim 12, wherein the sheet feeding means comprises sheet feeding rollers rotatable about a fixed axis and the manual feeding means comprises pressure rollers which are brought into contact with the sheet feeding rollers by a tension member.

14. A sheet feeder as claimed in claim 13, further comprising a manual sheet feeding passage through which a manually supplied sheet is insertingly guided to a space between the sheet feeding rollers and the pressure rollers.

* * * * *